US007383756B1

(12) United States Patent
Liu

(10) Patent No.: US 7,383,756 B1
(45) Date of Patent: Jun. 10, 2008

(54) TORQUE SCREWDRIVER STRUCTURE

(76) Inventor: Kuo-Tien Liu, P.O. Box 215, Taichung (TW) 40099

( * ) Notice: Subject to any disclaimer, the term of this patent is extended or adjusted under 35 U.S.C. 154(b) by 0 days.

(21) Appl. No.: 11/723,040

(22) Filed: Mar. 16, 2007

(30) Foreign Application Priority Data

Jan. 19, 2007 (TW) ..... 96201143 U

(51) Int. Cl.
*B25B 23/14* (2006.01)
*B25B 23/157* (2006.01)

(52) U.S. Cl. ..... 81/467; 81/473; 81/480

(58) Field of Classification Search ..... 81/467, 81/474, 475, 476, 478, 473, 480, 438
See application file for complete search history.

(56) References Cited

U.S. PATENT DOCUMENTS

| | | | | |
|---|---|---|---|---|
| 2,797,564 | A * | 7/1957 | Bonneau et al. | 81/475 |
| 4,517,865 | A * | 5/1985 | Huang | 81/475 |
| 6,662,693 | B2 * | 12/2003 | Hu | 81/467 |
| 7,219,583 | B1 * | 5/2007 | Chen | 81/467 |
| 7,222,559 | B2 * | 5/2007 | Wang | 81/467 |

* cited by examiner

*Primary Examiner*—Hadi Shakeri

(57) ABSTRACT

A torque screwdriver structure that has a positioning bar, a fixing ring, fixing balls, a sliding tube, a spring and a torque adjusting tuber providing strong mechanism between clutch and torque-adjusting button and being easy in use and simple in assembly when manufacturing.

8 Claims, 6 Drawing Sheets

TORQUE SCREWDRIVER STRUCTURE

BACKGROUND OF THE INVENTION

In prior art, its holder has a torque-setting mechanism inside, which is triggered through an torque-adjusting button that can move the operational bar vertically to depress or stretch the spring set between supporting ring and torque-adjusting nut. However, the mechanism between the clutch and the torque-adjusting button is weak, so the operational bar, clutch, spring, and the torque-adjusting nut would move synchronously when the torque-adjusting button is turned, making it unable to use.

SUMMARY OF THE INVENTION

The purpose of this invention is to propose a torque screwdriver structure that is convenient in use and simple in assembly. It comprises: a holder has, along the shaft axis, an elongated hole that further has a concave at the bottom set for being fitted by a positioning bar, and has inner threads on the top for threading with the male threads of an adjusting tube. Inside the elongated hole in order set the positioning bar, a sliding tube, a spring, the adjusting tube, and a screwdriver bit.

The positioning bar has, in one side, a fitting body that can fit with the aforementioned concave when assembled, and has, in the other side, a fixing ring with at least three equally-spaced ball holes on its wall. And further, each ball hole collaborates with one fixing ball. The sliding tube sets a conical hole at bottom to push fixing balls into or release them from the ball holes when the sliding tube slides along the fixing ring.

The spring is installed and stretches against the washer and the top face of the sliding tube on its both ends, and the other side of the washer is against the bottom of the adjusting tube.

The adjusting tube has a penetrating hole for the screwdriver bit bar to penetrate through, and male threads on the outer surface set to thread with the inner threads of the holder.

The screwdriver bit bar can contain screwdriver bit in one side, and, in the other side, is mounted with a thin rod that has multiple tooth at its bottom. The tooth can fit inside the fixing ring of the positioning bar in one side and collaborates with the conical hole of the sliding tube in the other side. The toothed grooves are curved shaped so that the fixing balls can well fit with the surfaces of them for firm fixture of the screwdriver bit bar. With aforementioned structure, the desired driving torque can be set by threading the adjusting tube inwards into or outwards from the holder to depress or stretch the spring. When the exerted driving torque is greater than the set driving torque, the fixing balls would be first forced out gradually from the toothed grooves to the tooth surface and then further push the sliding tube outwards until the bit bar is completely loosed from the positioning bar and sliding tube.

DETAILED DESCRIPTION OF THE INVENTION

Figure 1:
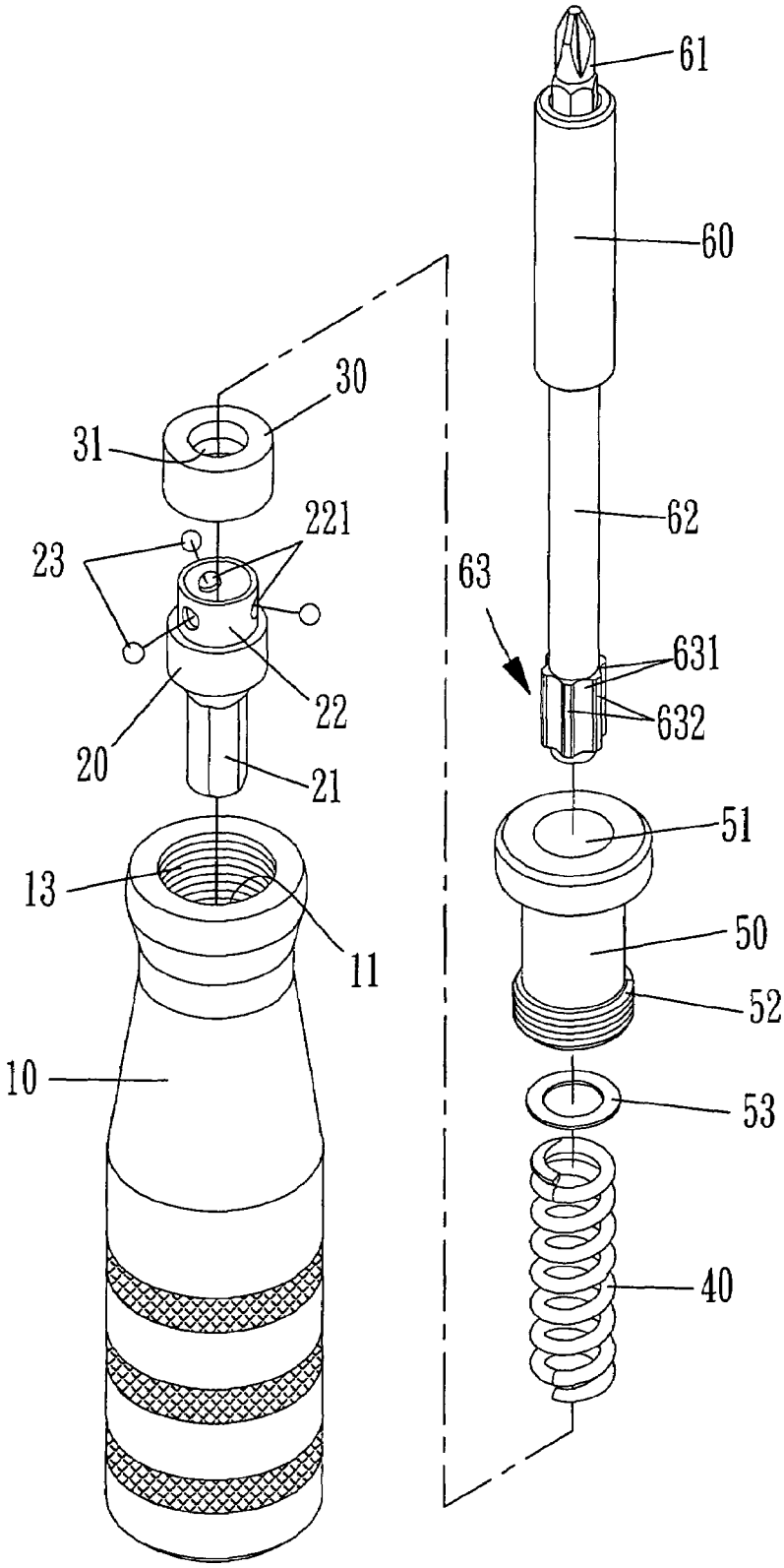
FIG. 1—An exploded view of the preferred embodiment of the invention
Figure 2:
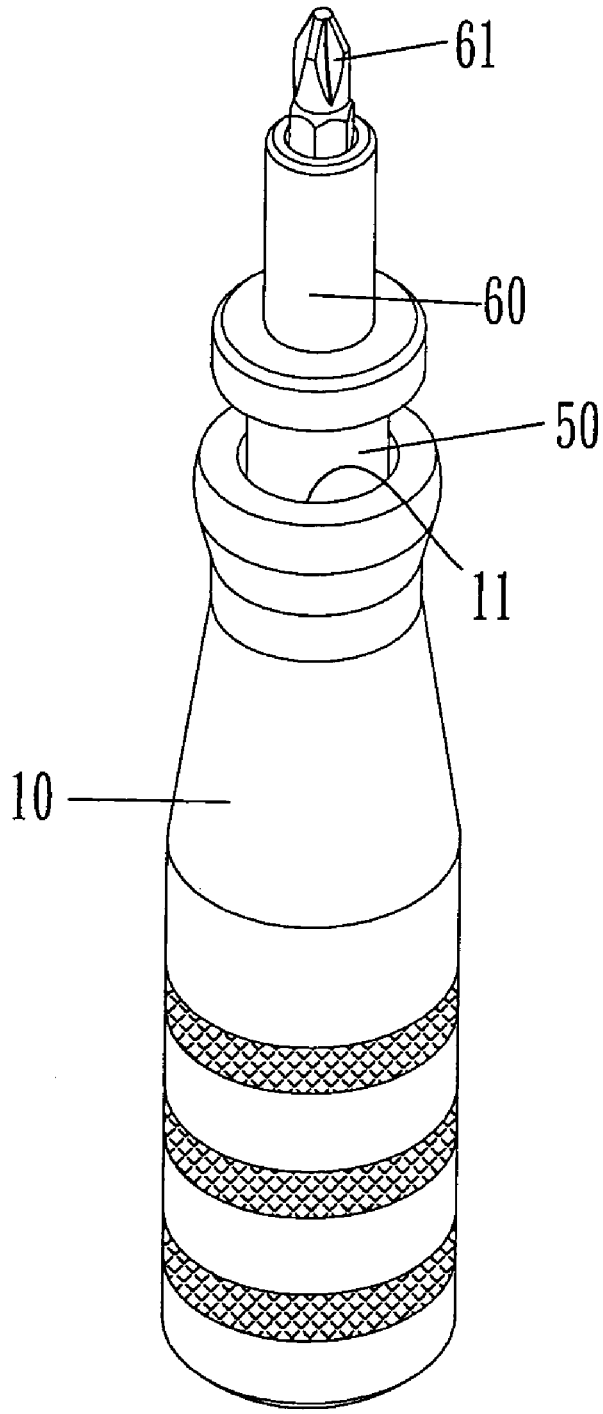
FIG. 2—A perspective view of the preferred embodiment of the invention

With references to the attached drawings, please be described of the preferred embodiment as follows. First, with references to FIGS. 1-4, this invention proposes a torque screwdriver structure that comprises: a holder 10, a positioning bar 20, a sliding tube 30, a spring 40, an adjusting tube 50, and a screwdriver bit bar 60.

The holder 10 has, along the shaft axis, an elongated hole 11 that further has a concave 12 at the bottom set for being fitted by the positioning bar 20, and has inner threads 13 on the top for threading with the male threads 52 of the adjusting tube 50. The positioning bar 20 has, in one side, a fitting body 21 that can fit with the concave 12 of the holder 10 when assembled, and has, in the other side, a fixing ring 22 with at least three equally-spaced ball holes 221 on its wall. And further, each ball hole 221 collaborates with one fixing ball 23.

The sliding tube 30 sets a conical hole 31 at bottom to push fixing balls 23 into or release them from the ball holes 221 when the sliding tube 30 slides along the fixing ring 22. This is so to fix the screwdriver bit bar 60.

The spring 40 is installed and stretches against the washer 53 and the top face of the sliding tube 30 on its both ends.

The adjusting tube 50 sets a penetrating hole 51 so that the screwdriver bit bar 60 can penetrate through the adjusting tube 50. It further has male threads 52 on the surface so as to thread with the inner threads 13 of the holder 10, and has a washer 53 at the bottom.

The screwdriver bit bar 60 can contain screwdriver bit in one side, and is mounted with a thin rod 62 that has multiple tooth 63 at its bottom. The tooth 63 can fit inside the fixing ring 22 in one side and collaborates with the conical hole 31 of the sliding tube 30 in the other side. The toothed grooves 631 are curved shaped so that the fixing balls 23 can well fit with the surfaces of them for firm fixture of the screwdriver bit bar 60. For collaboration purpose, the positions of multiple tooth 63 and toothed grooves 631 match with the that of ball holes 221.

Figure 3:
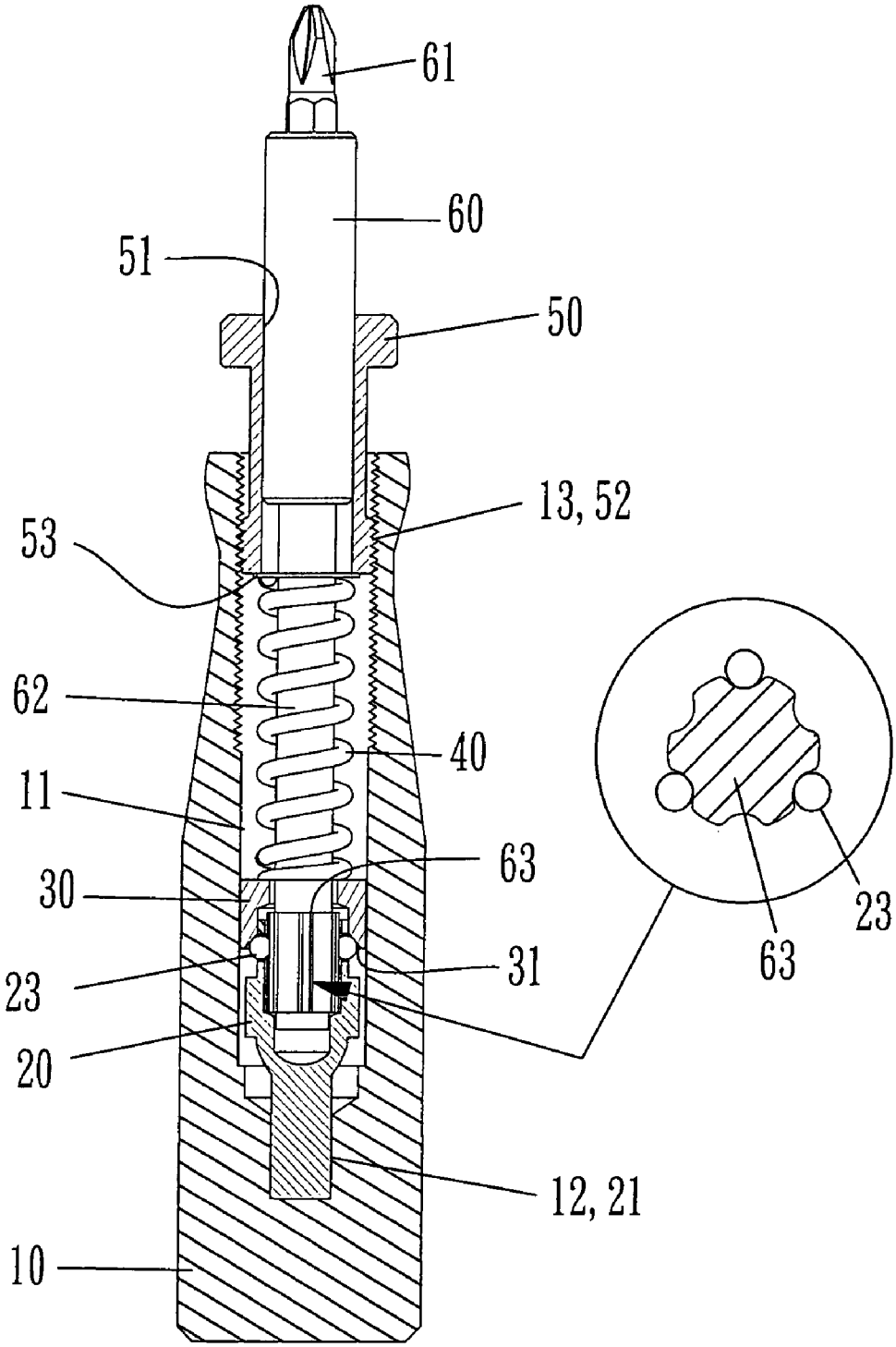
FIG. 3—A sectional view of the preferred embodiment of the invention

Moreover, as shown in FIG. 3, the spring 40 can be depressed or loosed by threading adjusting tube 50 into or out of the holder 10 so as to adjust the and set the driving torque.

When the exerted driving torque is greater than the set driving torque, the fixing balls 23 would be first pushed out gradually from the toothed grooves 631 to the tooth surface 632 and then they further push the sliding tube 30 outwards by interacting with the conical hole 31 until the bit bar 60 is completely loosed from the positioning bar 20 and sliding tube 30.

Figure 4:
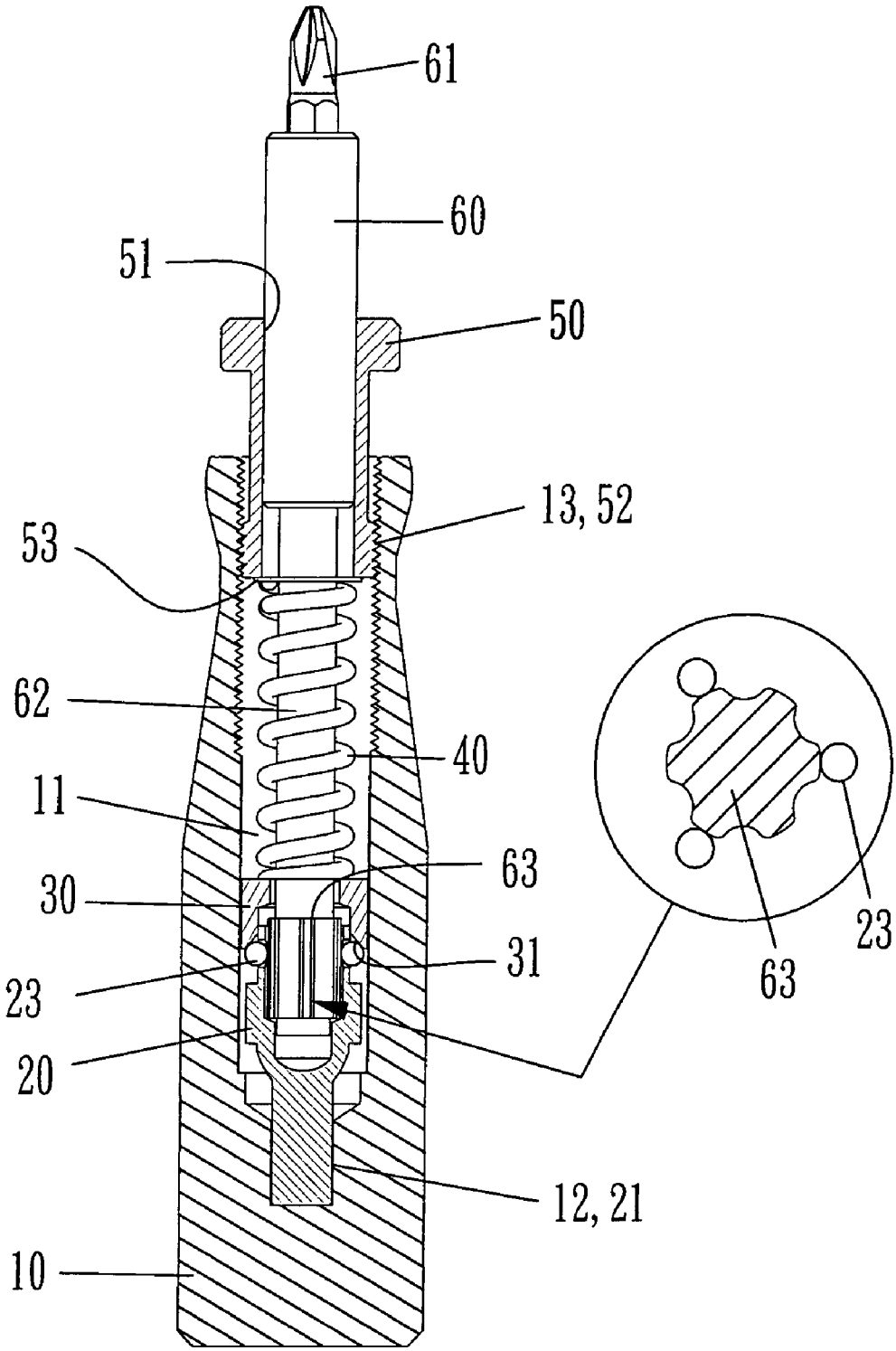
FIG. 4—Another sectional view of the preferred embodiment of the invention when in operation FIG. 5—A perspective view of the screwdriver bit bar of another preferred embodiment FIG. 6—A sectional view of the teeth part of the FIG. 5

Furthermore, as shown in FIGS. 3 and 4, because the radius of the spring 40 is slightly smaller than that of the penetrating hole 51, a washer 53 is set between them so that the spring 40 can be depressed more evenly and stably without bending. In case of an equal radius of the spring 40 to that of the penetrating hole 51, the washer 53 can be omitted.

From the tooth surface 632 to the toothed groove 631 is a curved surface, so the fixing balls 23 can roll easily in both left and right directions, which makes the torque screwdriver able to operate both clock- and counterclockwise as traditional screwdrivers.

Figure 5:
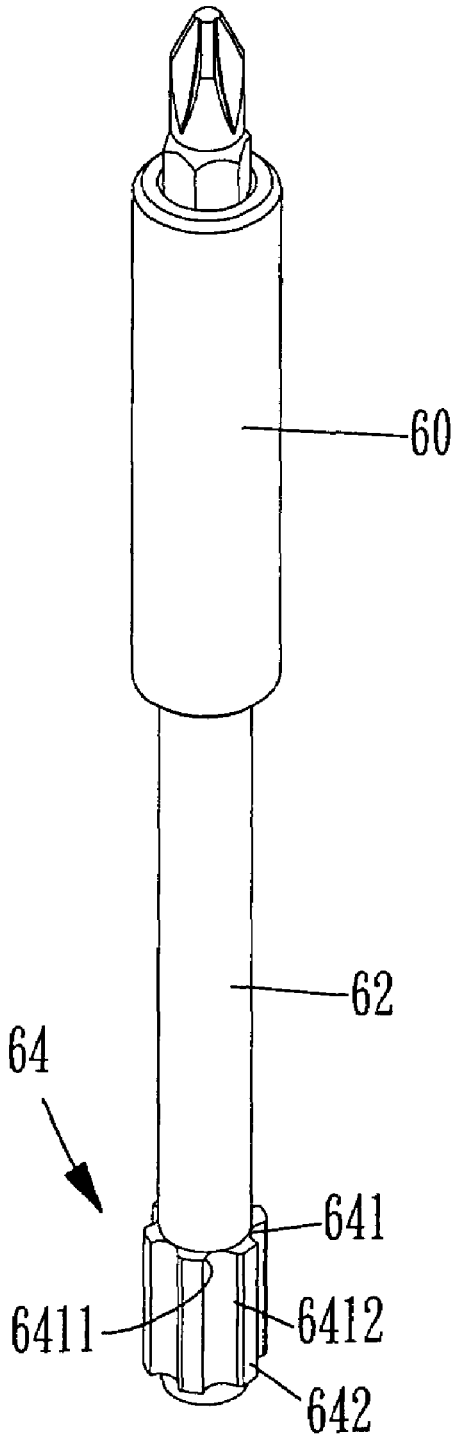
Figure 6:
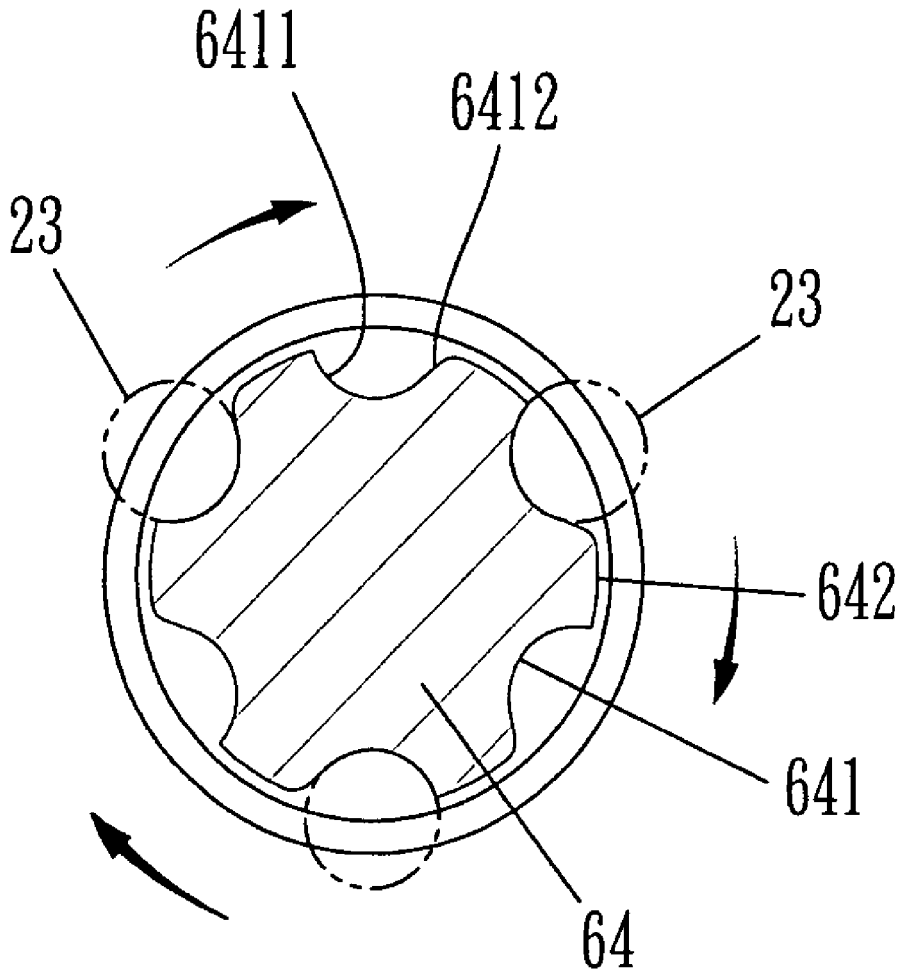

The FIGS. 5 and 6 show another embodiment for the screwdriver bit bar 60, which makes the torque screwdriver can only perform either clockwise or counterclockwise for certain operational needs. The feature is that, symmetrically for all teeth 63, one side of them is a 20 concaved surface 6411, and the other side is a convex surface 6412. The aforementioned concaved surface 6411 has the same radius and circle-center as the fixing balls 23 when they fit together. Besides, the length of the tooth is around the radius size of the fixing balls 23. This is so set that the concaved surface 6411 can prevent the fixing balls 23 from moving out of the toothed groove 631 for the purpose of locking the screwdriver bit, and on the contrary the convex surface 6412 allows the fixing balls 23 to roll out of the toothed groove 631 to release the screwdriver bit. With the aforementioned structure, therefore, a one-solo-direction torque screwdriver can be formed.

With all aforementioned, the invention deserves grant of a patent based on its capability of industrial application and absolute novelty. The example illustrated above is just an exemplary embodiment for the invention, and shall not be utilized to confine the scope of the patent. Any equivalent modifications within the scope of claims of the patent shall be covered in the protection for this patent.

What is claimed is:

1. A torque screwdriver structure comprising: a holder that has an elongated hole, and inner threads on its top; an adjusting tube has a penetrating hole for the screwdriver bit bar to penetrate through, and male threads on the outer surface set to thread with the said inner threads of the said holder; a positioning bar that has, in one side, a fitting body that can fit with the said holder, and has, in the other side, a fixing ring with at least three equally-spaced ball holes on its wall with each said ball hole collaborating with one fixing ball; a screwdriver bit bar, in one side, is mounted with a thin rod that in order fit with a spring and a sliding tube that has a conical hole at bottom; the said screwdriver bit bar further has multiple teeth at its bottom; the said teeth fit inside the said fixing ring of the said positioning bar in one side and collaborates with the said conical hole of the sliding tube in the other side; the driving torque can be set by threading the said adjusting tube clockwise or counterclockwise.

2. The torque screwdriver structure of claim 1, wherein the said elongated hole further extends a concave at its bottom to fit with the said fitting body.

3. The torque screwdriver structure of claim 1, wherein the said screwdriver bit bar can contain a screwdriver bit in one side.

4. The torque screwdriver structure of claim 1, wherein both sides of the said teeth are symmetrically convex surfaces.

5. The torque screwdriver structure of claim 1, wherein the said teeth, symmetrically on one side of them, is a concaved surface, and on the other side, is a convex surface; the aforementioned concaved surface has the same radius as the said fixing balls.

6. The torque screwdriver structure of claim 1, wherein the said spring stays against the bottom of the said adjusting tube and the top of the said sliding tube on its both ends.

7. The torque screwdriver structure of claim 1, wherein the positions of the said teeth match with that of the said ball holes.

8. The torque screwdriver structure of claim 1, wherein the adjusting tube further includes a washer at bottom.

* * * * *